US008967985B2

(12) United States Patent
Coghlan, III et al.

(10) Patent No.: US 8,967,985 B2
(45) Date of Patent: Mar. 3, 2015

(54) METAL DISK STACKED STATOR WITH CIRCULAR RIGID SUPPORT RINGS

(71) Applicant: Roper Pump Company, Commerce, GA (US)

(72) Inventors: Edmond Coghlan, III, Talmo, GA (US); Tyson Bentley Anderson, Watkinsville, GA (US); John Eugene Purcell, Commerce, GA (US); Zachariah Paul Rivard, Nicholson, GA (US)

(73) Assignee: Roper Pump Company, Commerce, GA (US)

( * ) Notice: Subject to any disclaimer, the term of this patent is extended or adjusted under 35 U.S.C. 154(b) by 228 days.

(21) Appl. No.: 13/675,668

(22) Filed: Nov. 13, 2012

(65) Prior Publication Data

US 2014/0134029 A1 May 15, 2014

(51) Int. Cl.
*F04C 2/107* (2006.01)
*B23P 15/14* (2006.01)

(52) U.S. Cl.
CPC ..... *F04C 2/1075* (2013.01); *F04C 2230/22* (2013.01); *F04C 2230/23* (2013.01)
USPC ..... 418/48; 418/49; 29/888.023

(58) Field of Classification Search
USPC ..... 418/48, 49; 29/888.023
See application file for complete search history.

(56) References Cited

U.S. PATENT DOCUMENTS 1,892,217 A 12/1932 Moineau
2,527,673 A 10/1950 Bryam
3,771,906 A 11/1973 Bourke
3,975,120 A 8/1976 Tschirky
3,975,121 A * 8/1976 Tschirky ..... 418/48
4,144,001 A * 3/1979 Streicher ..... 418/48
4,211,521 A * 7/1980 Streicher ..... 418/48
5,171,138 A 12/1992 Forrest
5,318,416 A * 6/1994 Hantschk et al. ..... 418/48
5,807,087 A * 9/1998 Brandt et al. ..... 418/48
5,807,097 A 9/1998 Dobbeling et al.
5,832,604 A * 11/1998 Johnson et al. ..... 29/888.023
6,241,494 B1 6/2001 Pafitis et al.
7,040,878 B2 5/2006 Denk et al.

(Continued)

FOREIGN PATENT DOCUMENTS

GB 1238237 7/1971
GB 1567880 5/1980

*Primary Examiner* — Mary A Davis
(74) *Attorney, Agent, or Firm* — Caesar, Rivise, Bernstein, Cohen & Pokotilow, Ltd.

(57) ABSTRACT

A stator for a helical gear device is formed from multiple rigid disks and support rings bonded to the disks. Each disk forms part of a profile consisting of radially equally spaced or opened lobes which interact with the convex portions of rotor lobes. The disks are arranged into a desired helical configuration and bonded to one another to form a disk stack defining a helically convoluted elongated chamber therein. The support rings are fixed concentrically against respective end disks of the disk stack. The rings are sized with an inside diameter substantially equal to the major diameter of the central aperture defined by the radially extending lobes of the rigid disks. As a rotor rotates and nutates inside the helically convoluted elongated chamber of the stator, it is supported at both ends of the disk stack by the support rings touching the tips of the rotor lobes. Thus the full force of the rotor's operational inertia is not borne by the disks alone, thereby increasing their life.

18 Claims, 5 Drawing Sheets

(56) References Cited

U.S. PATENT DOCUMENTS

| | | | | |
|---|---|---|---|---|
| 7,104,770 | B2 | 9/2006 | Bauer et al. | |
| 8,007,259 | B2 | 8/2011 | Kreidl et al. | |
| 8,851,867 | B2 * | 10/2014 | Thomas | 418/48 |
| 2010/0196182 | A1 | 8/2010 | Loeker et al. | |
| 2010/0284842 | A1 * | 11/2010 | Jager | 418/48 |
| 2010/0284843 | A1 | 11/2010 | Jäger | |
| 2012/0063941 | A1 | 3/2012 | Overmeier et al. | |
| 2012/0156078 | A1 | 6/2012 | Guidry, Jr. | |

* cited by examiner

METAL DISK STACKED STATOR WITH CIRCULAR RIGID SUPPORT RINGS

BACKGROUND OF THE INVENTION

1. Field of Invention

This invention relates generally to gear pumps, and more particularly, to internally rigid laminated stators for helical gear pumps and motors.

2. Description of Related Art

Today's downhole drilling motors usually are of the convoluted helical gear expansible chamber construction because of their high power performance and relatively thin profile and because the drilling fluid is pumped through the motor to operate the motor and is used to wash the chips away from the drilling area. These motors are capable of providing direct drive for the drill bit and can be used in directional drilling or deep drilling. In the typical design the working portion of the motor comprises an outer housing having an internal multi-lobed stator mounted therein and a multi-lobed rotor disposed within the stator. Generally, the rotor has one less lobe than the stator to facilitate pumping rotation. The rotor and stator both have helical lobes and their lobes engage to form sealing surfaces which are acted on by the drilling fluid to drive the rotor within the stator. In the case of a helical gear pump, the rotor is turned by an external power source to facilitate pumping of the fluid. In other words, a downhole drilling motor uses pumped fluid to rotate the rotor while the helical gear pump tarns the rotor to pump fluid. In prior systems, one or the other of the rotor/stator shape is made of an elastomeric material to maintain a seal there between, as well as to allow the complex shape to be manufactured.

One of the primary problems encountered when using the standard style of stators is that the profile lobes are typically formed entirely of elastomer. Since swelling due to thermal expansion or chemical absorption is proportional to the elastomer thickness different parts of the profile expand differently. Moineau, U.S. Pat. No. 1,892,217 and Bourke, U.S. Pat. No. 3,771,906 disclose stators constructed from elastomeric materials of varying section thickness of the elastomer. Use of a thinner even elastomer layer or eliminating it all together in rigid stators diminishes or eliminates this problem. Additionally, the solid backing of the disk profile stiffens the system increasing the stators performance.

Examples of rigid convoluted helical stators are disclosed in Byram, U.S. Pat. No. 2,527,673 and Forrest, U.S. Pat. No. 5,171,138. The use of a rigid stator—rather than an elastomeric stator—substitutes for the softer inwardly projecting thick lobes, with the more rigid lobes permitting transmittal of higher torsional forces. Although an elastomer may still be used in pumps or motors having this type of stator at the interface between the rotor and stator to coat the stator and avoid metal-to-metal contact between the rotor and stator, the function of the elastomer in a rigid stator is primarily to provide a resilient seal between the rotor/stator, and to help compensate for machining variations and tolerances. A low modulus elastomer sleeve is not required to maintain the "geometry" of the stator lobes under conditions of high unit loading, which is a job ill suited to a low modulus material. Therefore, it is this well known that a rigid helical stator with a thin uniform elastomeric sealing member on its lobed surfaces is superior in performance to typical elastomeric stators of relatively thick and varying cross-sections.

Still, a long term problem continues in providing an improvement in the durability of the stator. The inventors have contemplated and solved this problem by inventing an elongated stator that is extremely rigid and which forms the internal helical lobes that form the rotor cavity that is inexpensive to produce and is durable and reliable in operation as will be discussed in greater detail below.

All references cited herein are incorporated herein by reference in their entireties.

BRIEF SUMMARY OF THE INVENTION

This summary is provided to introduce a selection of concepts in a simplified form that are further described below in the detailed description. This summary is not intended to identify essential features of the claimed subject matter, nor is it intended for us in determining the scope of the claimed subject matter.

In accordance with an example of the invention, a stator for a helical gear device includes a plurality of rigid disks, a bonding member fixedly attached to the rigid disks to bond the rigid disks together as a disk stack, and a plurality of rigid support rings fixedly attached to the disk stack. The bonded rigid disks define a helically convoluted elongated chamber, with each of the rigid disks having an interior surface with radially extending lobes defining a central aperture. The rigid disks are concentrically aligned face-to-face in a stacked helical relationship with one another with each disk rotated with respect to an adjacent one of the rigid disks progressively along a length of the disk stack in one direction of rotation to define a helically convoluted elongated chamber. The plurality of rigid support rings includes a first ring and a second ring fitted concentrically at opposite ends of the disk stack against the respective end rigid disks of the disk stack. The rings are sized with an inside diameter substantially equal to the major diameter of the central aperture defined by the radially extending lobes of the rigid disks and support a rotor nutatively disposed in the helically convoluted elongated chamber by contact with the rotor. The support rings are preferably annular.

In accordance with another example of the invention, a method of making a stator for a helical gear device includes the steps of: a) stacking a plurality of rigid disks in aligned face-to-face stacked relationship with one another with each disk rotated with respect to the next adjacent disks progressively along the length of the aligned disks in one direction of rotation to define a helically convoluted elongated chamber, each of said disks defining in cross-section an opening defining radially extending lobes corresponding to the helical lobes of a rotor where the rotor has one less lobe than the stator; b) fixing the rigid disks together to make a bonded disk stack; c) coupling a first rigid support ring concentrically to a rigid disk at a first end of the disk stack; and d) coupling a second rigid support ring concentrically to a rigid disk at a second end of the disk stack opposite the first end, the first and second rings being sized with an inside diameter substantially equal to the major diameter of the central aperture defined by the radially extending lobes of said rigid disks, said rings supporting a rotor nutatively disposed in said helically convoluted elongated chamber by contact with the rotor.

Further scope of applicability of the present invention will become apparent from the detailed description given hereinafter. However, it should be understood that the detailed description and specific examples, while indicating preferred embodiments of the invention, are given by way of illustration only, and that the invention is not limited to the precise arrangements and instrumentalities shown, since the invention will become apparent to those skilled in the art from this detailed description.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
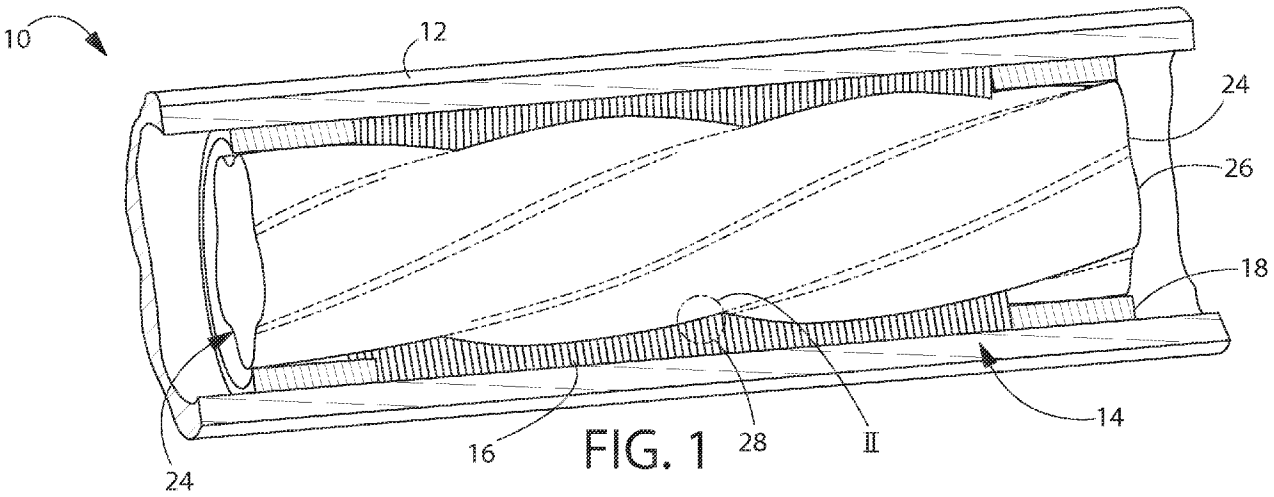
FIG. 1 is a perspective view of an exemplary stator partially cut away in accordance with the exemplary embodiments of the invention.

The present invention will now be described with reference to the accompanying drawings, in which preferred embodiments of the invention are shown. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Like numbers refer to like elements throughout.

Examples of the present invention include a stator for a helical gear device that is formed from multiple rigid disks and support rings bonded to the disks. The disks are similar and preferably, but not necessarily, identical disks. Each disk forms part of a profile consisting of radially equally spaced or opened lobes which interact with the convex portions of rotor lobes. The disks are arranged into a desired helical configuration and bonded to one another to form a disk stack defining a helically convoluted elongated chamber therein. The support rings include a first support ring and a second support ring fixed concentrically at opposite ends of the disk stack against respective end disks of the disk stack. The rings are sized with an inside diameter substantially equal to the major diameter of the central aperture defined by the radially extending lobes of the rigid disks. As a rotor rotates and nutates inside the helically convoluted elongated chamber of the stator, it is supported at both ends of the disk stack by the support rings touching the tips of the rotor lobes. Thus the full force of the rotor's operational inertia is not borne by the disks alone, thereby increasing their life. If desired, the disk stack may be placed into a tube and bonded to the tube to provide further structural support to the disks. While not being limited to a particular theory, an internal coating may be applied to the interior surface of the bonded disks.

The current invention includes a manufacturing process for making an internally rigid stator for pump and motor applications utilizing support rings on opposite sides of a lobed internal helical profile which preferably contains one more lobe than the rotor. This profile is made from a laminated stack of thin disks bonded to one another to form the desired stator profile. The disks which make up the inner rigid profile may be manufactured in a variety of ways, with preferred methods including machining via laser, water jet, electrical discharge machining (EDM), milling etc. or a stamping/punching process. They may also be made to shape originally by casting, powder metallurgy or any similar process. The driving force behind the method of disk manufacture is the disk material and the cost of manufacture for that material. For example stamping is cost effective for most disks made of metals but unfeasible for disks made of ceramics. The thickness of the disks determines the size of the step between the disk edges as they are aligned into the desired helical formation; the thicker the disk the larger the step.

While the various components may be constructed of any material suitable for contact with the human body, the preferred materials of the disks and support rings are metal, for example, steel. The disks may be assembled into a helix by stacking the disks about a mandrel or jig that interacts with lobed features of the disks. The disks may be made in such a way that openings following the helix of the stator for passage of controls, sensors, fluid etc. are created down the length of the stator. The disks are then bonded to one another to form the disk stack. Support rings having an inner diameter matching the maximum inner diameter of the lobed disks are bonded to the end disks of the disk stack. The disk stack and bonded support rings may then be inserted into the stator tube, where it is then bonded or mechanically fixed to the tube housing. The stator may or may not have an inner lining which is generally composed of an elastomer, plastic, ceramic or metal.

Figure 3:
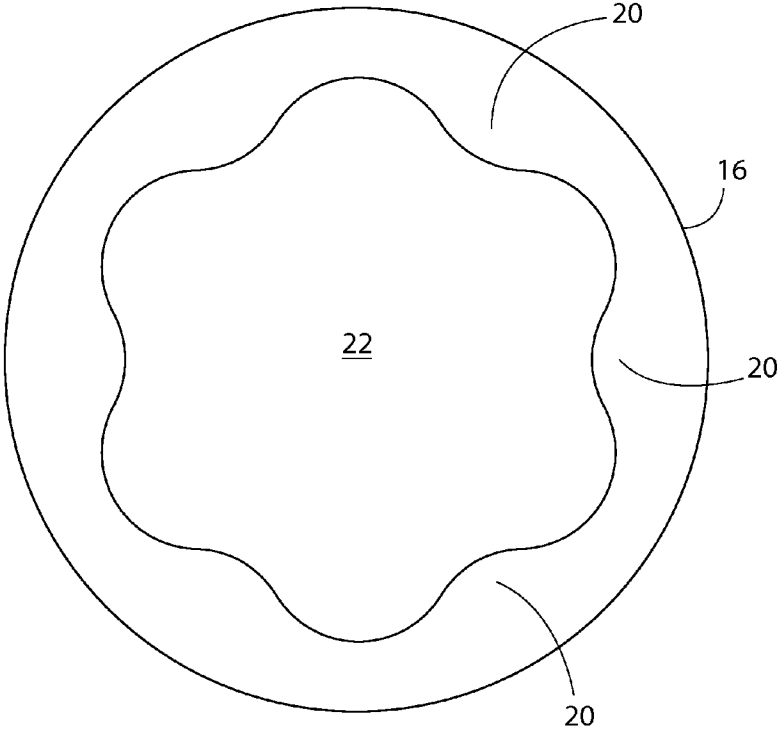
FIG. 3 is a top view of an exemplary stator disk.

FIG. 1 depicts an exemplary embodiment of a stator 10 partially cut away showing an cylindrical outer housing or tube 12, a disk stack 14 of a plurality of like-shaped lobed disks 16, and annular support rings 18. The disks 16 in the disk stack 14 share a common centerline with each disk rotated slightly from the disks on either side to form a helical winding inside the housing 12. The disks 16 may be placed into a helical configuration of the disk stack 14 by stacking the disks onto an alignment assembly via means for stacking, including an alignment mandrel/core with a profile that catches lobes 20 of the disks with its profile cut in a helical pattern in the alignment core, as readily understood by a skilled artisan (FIG. 3). The disks may also be aligned with an alignment assembly including a jig which interacts with disk features other than the inner profile or through features built into the disks (e.g., apertures through the disk lobes) that rotate each disk slightly relative to neighboring disks.

In some cases it is then necessary to tighten the alignment of the disk stack 14 by the application of force to the outer diameter of the stack by, for example, swaging, v-blocking or hammering in either a static or rotating condition. The disk stack 14 is then bonded together by means for fixing the rigid disks together including a bonding member provided by, for example, welding, fusing, soldering, brazing, sintering, diffusion bonding, mechanical fastening, or via an adhesive bond. The tube 12, which preferably is made of metal, may be straightened, chamfered, machined, cleaned and heated as required and understood by a skilled artisan. The tube 12 is another bonding member that may then be slid over the tube 12 and bonded to the tube by means for bonding (e.g., welding, fusing, soldering, brazing, sintering, diffusion bonding, mechanical fastening, adhesive) as another means for fixing the rigid disk together. The alignment assembly may then be removed from the disk stack 14. It should be noted that depending on the disk stack alignment methodology, it may be required or preferred to insert the stack 14 into the outer housing 12 without the alignment tooling entering the outer housing as well.

Support rings 18 are fitted concentrically to and fixedly attached to opposite ends of the disk stack 14 preferably by mechanically or chemically bonding the support rings 18 to the disk 16 located at each end of the disk stack as a means for coupling the rings to the disk stack. In this exemplary configuration, the support rings 18 lie at the ends of the disk stack that define the helically convoluted elongated chamber profiled at the inside of the stator 10. The support rings 18 are preferably annular and sized so that the inside diameter is the same as the major (e.g., maximum) diameter of the profile formed in the lobed disks 16. In other words, when fixedly attached to the disk stack 14 as exemplified in FIG. 1, the support rings 18 have an inside diameter substantially equal to the major diameter of the interior surface of the lobed disks so that the interior surface of the support ring and of the end disk meet at the major diameter of the lobed disk. This means that as a rotor 24 rotates and nutates inside the helically convoluted elongated chamber of the stator 10, it is supported at both ends of the disk stack 14 by the support rings 18 touching the tips of the rotor lobes 26. This means that the full force of the rotor's inertia from the eccentric path that it describes is not borne by the disks 16 alone, thus increasing their life. The support rings may also be slid into the tube 12 and bonded to the tube by means for bonding (e.g., welding, fusing, soldering, brazing, sintering, diffusion bonding, mechanical fastening, adhesive) to become a monolithic structure.

Figure 2:
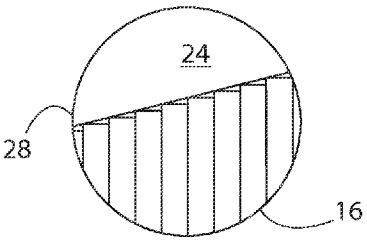
FIG. 2 is an enlarged view showing a profile of an exemplary disk stack of FIG. 1.

While not being limited to a particular theory, the lobed disks 16 are stacked with a small angular difference between each disk and the disks to either side of it, which can be seen in encircled section 28 of FIG. 1. This small angular difference between successive disks 16, as shown by the enlarged view in FIG. 2, may produce a surface that is shaped like a saw tooth from the perspective of the rotor 24. This means that as the fluid passes through the motor, bypassed fluid that leaks through the gap between the rotor 24 and stator 10 must cross many small tight spots, with larger gaps in between. The inventors had discovered that this has the same effect in the motor as it does in a labyrinth seal, as it increases the resistance to this bypass flow, and therefore reduces it. This makes the motor more efficient and less prone to stalling than if the inside of the stator profile were smooth.

Figure 4:
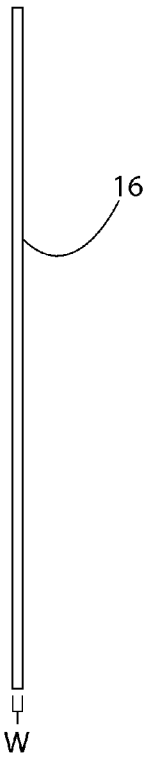
FIG. 4 is a side view of an exemplary stator disk.

As can best be seen in FIG. 3, each disk 16 includes a convoluted cavity 22 with the exemplary disk having a number of equally spaced symmetrical lobes 20 radially extending toward the centerline. Preferably all of the disks have substantially identical construction and dimension. The width W of each disk (FIG. 4), while most preferably the same thickness of, for example, about 0.0625 inches, may vary between about 0.005 inches thick to several inches thick within the scope of the invention. In comparison, the support rings 18 preferably have a width greater than the width W of each disk to bear the force of the rotor's inertia and lessen any excessive force previously borne by the disks 16 at the ends of the disk stack.

Figure 5:
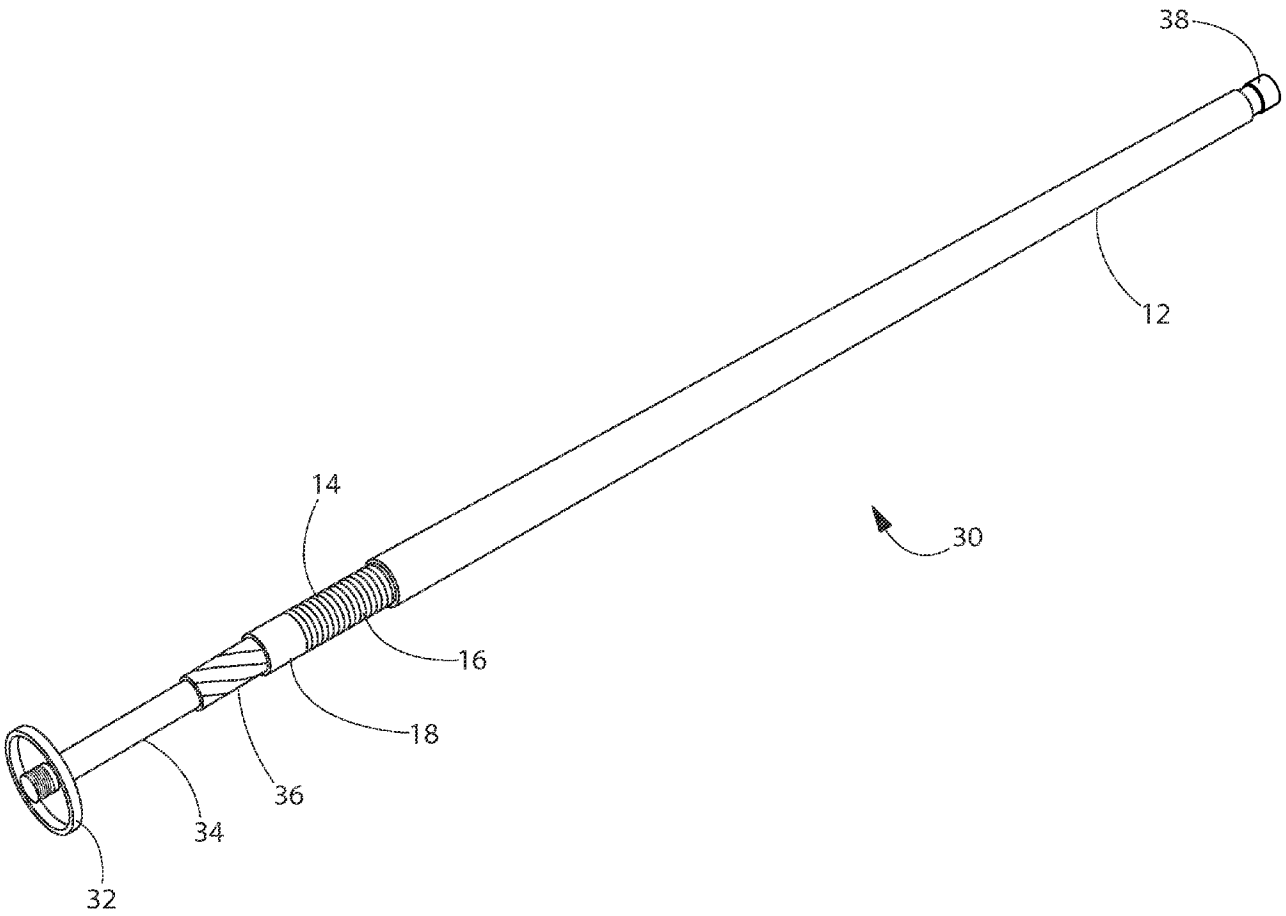
FIG. 5 is a perspective view of an exemplary alignment assembly used to stack disks into the proper alignment for a disk stack.

FIG. 5 depicts an exemplary alignment assembly 30 that may be used to stack the disks 16 into the proper alignment, and allows the bonded disk stack 14 and the support rings 18 to be inserted into the outer housing tube 12. The alignment assembly 30 includes an alignment plate 32 coupled to a spacer bushing 34 that insure the disk stack 14 is in the right position relative to the outer housing tube. For example, when the tube 12 is placed against the alignment plate 32, the spacer bushing 34 spatially offsets the disk stack 14 within the tube generally by the length of the spacer bushing. The alignment assembly 30 also includes an alignment core 36 as a mandrel coupled to the spacer bushing 34 that forces the disk stack 14 into the proper helical configuration. A pressure or pilot cap 38 at the distal end of the alignment assembly 30 and attached to a spacer bushing at the distal end (not shown) holds the disk stack 14 and the tube in place. The pressure cap 38 preferably has a diameter larger than the inner diameter of the support rings 18 and smaller than the inner diameter of the tube 12 so that during assembly of the stator 10, the pressure cap can abut the support ring within the tube. While not being limited to a particular theory, the alignment plate 32, spacer bushing 34, alignment core 36 and pressure cap 38 may be attached to form the alignment assembly 30 via threaded engagement with threaded connector bolts at the axis of the alignment assembly. The cap 38 preferably has the same diameter as the disk stack 14 and can enter the tube 12.

Still referring to FIG. 5, the spacer bushing 34 is shown as having an outer diameter larger than the minimum inner diameter of the disk 16 and smaller than the inner diameter of the support rings 18. At this size, the disk stack 14 does not slide over the spacer bushing 34, and the support rings 18 that are shown bonded to the disk stack may slide over the spacer bushing. It is understood that the spacer bushing 34 may have an outer diameter larger than the inner diameter of the support rings 18 and smaller than the inner diameter of the tube 12, such that the support rings do not slide over the spacer bushing, which may slide into the tube. Alternatively the spacer bushing 34 may have an outer diameter larger than the inner diameter of the tube 12, such that the spacer bushing 34 remains outside the tube where the spacer bushing may abut the tube. Preferably the support rings 18 are press fitted into the tube 12.

Figure 6:
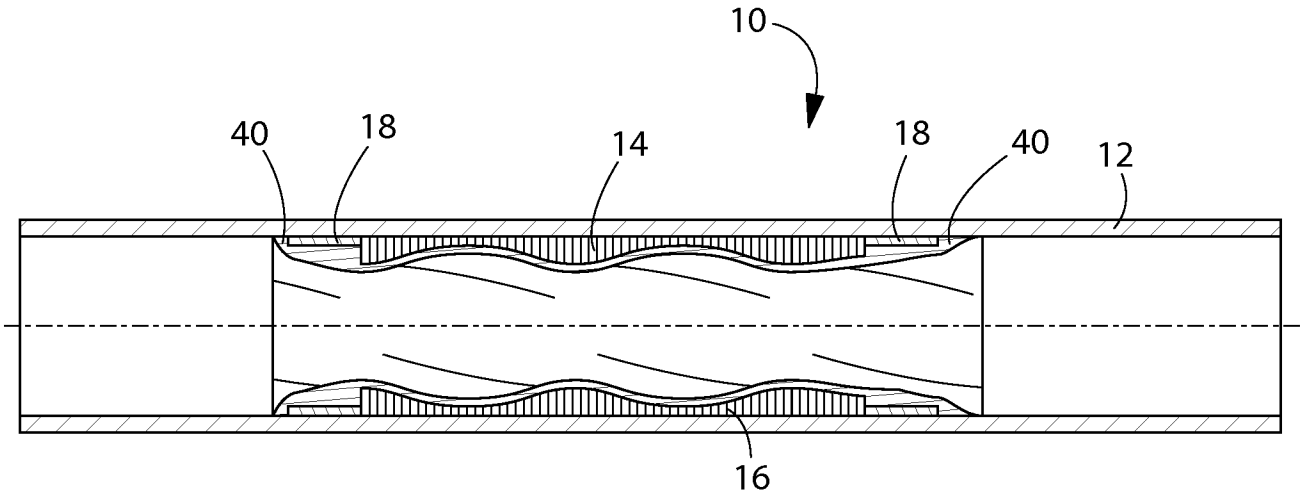
FIG. 6 is a cross sectional view of another exemplary stator of the invention.

It should be noted that in an exemplary embodiment the disk stack provides the final profile geometry of the stator 10. This embodiment eliminates the need for an inner lining. However an inner lining may be added to the stator, for example, with an injection mold core, as readily understood by a skilled artisan. Preferably such an inner lining would be added to the disk stack 14 and the support rings 18 as necessary to keep the inner diameter of the support rings equal to or about equal to the maximum inner diameter of the disks 16. One exemplary inner lining is depicted in FIG. 6, which shows a stator 10 with the disk stack 14 bonded to the support rings 18 and the outer housing tube 12, and an inner lining 40 bonded to the disk stack, the support rings and the tube.

It should be noted that the invention is not limited to one type of lining. For example, the inner lining 40 may be an elastomer formed over the rigid inner profile to form an approximately even coating of the elastomer. As another example, the inner lining 40 may be a thermal set plastic formed over the rigid inner profile to form an approximately even coating of the plastic. As yet another example, the inner lining 18 may be a coating of metal over the rigid inner profile to form an approximately even coating of the metal. Moreover, the inner lining 18 may be a metal applied by sintering or sputtering to form an approximately even coating of the metal.

Figure 7:
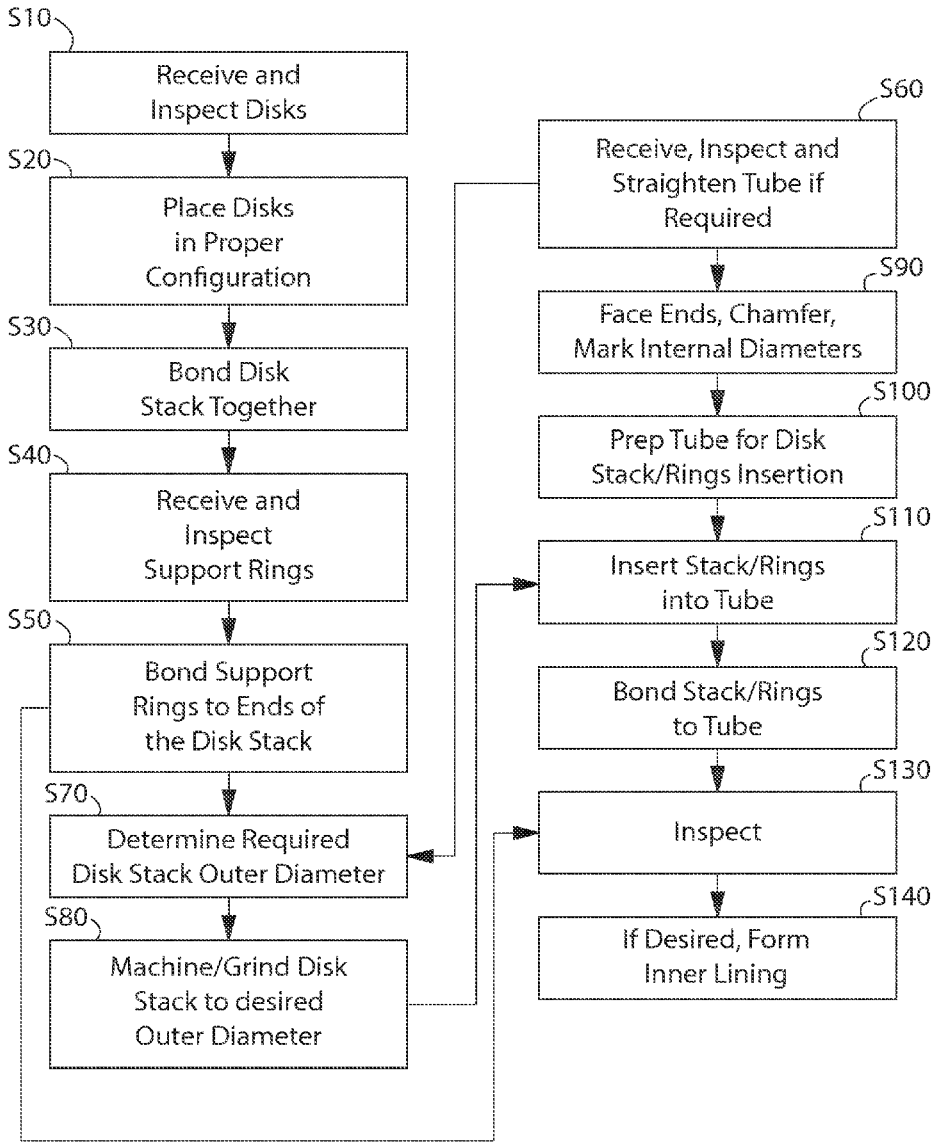
FIG. 7 is a block diagram illustrating the procedures for producing the exemplary stator.

An exemplary method tor manufacturing the laminated stator includes the following steps with reference to the process flow chart illustrated in FIG. 7. After the disks 16 are received and inspected at Step S10, the disks are placed in proper configuration at Step S20. For example, the alignment core tooling is partially assembled and the disks are stacked about it and placed in compression with compression springs to keep the disk stack tight as the alignment tooling is fully assembled. An exemplary compression spring resembles a cupped washer, with a hole in its center for sliding the spring over a portion of the tooling, where the spring is preferably placed either immediately before or after the pressure cap. A threaded nut aligned with the end of the tooling is tightened to compress the spring and transfer that compression load to the disk stack and keep the disk stack tight. At Step S30 the disk stack 14 is bonded together, for example, by running weld beads down the length of the disk stack 14 or by brazing the stack together.

At Step S40 support rings 18 are received and inspected to confirm that the inner diameter of the support ring matches the maximum inner diameter of the disk stack. After confirmation the support rings 18 are bonded (e.g., welded, brazed, mechanically, chemically) concentrically to the disk at the ends of the disk stack 14, at Step S50, so that the support rings and the disk stack have the same central axis with the inner diameter of the support rings aligned with the maximum inner diameter of the disks. While not being limited to a particular theory, completion of the Step S50 provides a bonded stator of the combined disk stack and support ring assembly. The strength and durability of the bonded stator may be increased by insertion of the stator into the housing tube 12 as discussed in greater detail below.

Upon receipt, inspection, and any correction (e.g., straighten) of the housing tube 12 at Step S60, the tube may be measured, in particular for its internal diameter. From this measurement, the required outer diameter of the disk stack and support rings is confirmed at Step S70 for optimal fitting therebetween, as would readily be understood by a skilled artisan. For example, the optimal fitting may require that the outer diameter of the bonded stator is slightly less than, equal to, or slightly larger than the inner diameter of the tube based on the materials of the bonded stator and tube, and the use of heat or lubricants. If needed, the disk stack is machined, polished or ground to the desired outer diameter at Step S80. For example, the compression springs are removed, the pilot cap put on the alignment core, and the assembly is machined, polished or ground to the desired outer diameter if required. It is also understood that as an exemplary alternative, the core of the tube may be resized to an inner diameter desired for attachment to the bonded stator.

Still referring to FIG. 7, at Step S90 the tube 12 is sized (e.g., faced to length) and chamfered. The tube is then prepared for stack insertion at Step S100. At Step S110, the bonded stator is inserted into the tube. A hydraulic ram or some other pushing/pulling tool can be used, preferably with the alignment assembly 30 to aid in inserting the bonded stator into the tube.

The bonded stator is then bonded to the tube at Step S120. For example, apertures or channels for plug welding may be milled through the tube wall and then the disk stack may be plug welded to the tube. The alignment assembly 30 may be removed from the bonded stator and tube assembly before or after Step S120. Removal of the alignment assembly is preferred after the bonding step since the alignment assembly may help stabilize the bonded stack during Step S120.

The tube assembly (e.g., bonded housing tube, disk stack and support rings) is then inspected at Step S130. If desired, an inner elastomeric lining 18 may be formed in the tube assembly at Step S140. For example, the lining material may be injected into the tube assembly and then placed in an autoclave to cure.

In any of the exemplary configurations discussed above the disks are preferably formed in such a way as to leave a helical passage open down the length of the stator which can be used for fluid bypass, control runs, sensor runs or any other operation that would be aided by such a passageway. As discussed above, the lobed disks are stacked with a small angular difference between each disk and the disks to either side of it, which may produce a surface that is shaped like a saw tooth from the perspective of a rotor. In addition to the labyrinth seal provided by this profile, this surface also provides advantages for bonding to an inner lining. For example, if there is an adhesive/chemical/bonding agent applied to the inner profile to hold the inner lining in place it is protected from damage as the molding tooling is assembled unlike a smooth surface. Such steps also alter the vectors of applied loads by providing two perpendicular surfaces bonded to the inner lining thus providing better resistance to shearing forces.

While the invention has been described in detail and with reference to specific examples thereof, it will be apparent to one skilled in the art that various changes and modifications can be made therein without departing from the spirit and scope thereof. Without further elaboration, the foregoing will so fully illustrate the invention that others may, by applying current or future knowledge; readily adapt the same for use under various conditions of service.

What is claimed is:

1. A helical gear device, comprising:

a stator comprising of a plurality of rigid disks stacked together in a disk stack defining a helically convoluted elongated chamber, each of said rigid disks having an interior surface defining a central aperture, said interior surface including a plurality of circumferentially spaced apart, radially inwardly extending lobes and surface regions between said radially inwardly extending lobes, wherein diametrically opposed surface regions between said radially inwardly extending lobes provide the major diameter of said central aperture, said rigid disks being concentrically aligned face-to-face in a stacked helical relationship with one another with each rigid disk rotated with respect to an adjacent one of said rigid disks progressively along a length of said disk stack in one direction of rotation to define the helically convoluted elongated chamber;

a bonding member fixedly attached to said rigid disks to bond said rigid disks together as said disk stack; and a plurality of rigid support rings fixedly attached to said disk stack, each of said rigid support rings having a central opening being circular in cross-section and having a constant diameter, said rigid support rings including a first rigid support ring and a second rigid support ring, said first and second rigid support rings fitted concentrically at opposite ends of said disk stack against end rigid disks of said disk stack, said constant diameter of said central opening of said first and second rigid support rings being substantially equal to the major diameter of the central aperture, said rigid support rings supporting a rotor nutatively disposed in said helically convoluted elongated chamber by contact with the rotor.

2. The helical gear device of claim 1, further comprising said rigid disks being metal disks.

3. The helical gear device of claim 2, further comprising said rigid support rings being metal support rings.

4. The helical gear device of claim 1, further comprising said rigid support rings being metal annular support rings.

5. The helical gear device of claim 1, further comprising said disk stack having a saw tooth surface that during nutative communication with the rotor provides a labyrinth seal therebetween.

6. The helical gear device of claim 1, said bonding member including a tube housing, said disk stack and said rigid support rings are located within said tube housing and are bonded to said tube housing.

7. The helical gear device of claim 6, wherein said disk stack and said rigid support rings are mechanically fixed to said tube housing.

8. The helical gear device of claim 1, wherein said first and second rigid support rings are bonded to respective said end rigid disks of said disk stack.

9. The helical gear device of claim 1, further comprising an inner lining attached to the interior surface of the rigid disks within the helically convoluted chamber.

10. A method of making a helical gear device, the method comprising:

making a stator by stacking a plurality of rigid disks in aligned face-to-face stacked relationship with one another with each rigid disk rotated with respect to the next adjacent rigid disks progressively along the length of the aligned rigid disks in one direction of rotation to define a helically convoluted elongated chamber, each of said rigid disks having an interior surface defining in cross-section a central aperture, said interior surface including a plurality of circumferentially spaced apart, radially inwardly extending lobes and surface regions between said radially inwardly extending lobes, wherein diametrically opposed surface regions between said radially inwardly extending lobes provide the major diameter of said central aperture, said radially inwardly extending lobes corresponding to the helical lobes of a rotor where the rotor has one less lobe than the stator;

fixing the rigid disks together to make a bonded disk stack;

providing first and second rigid support rings, each of said first and second rigid support rings having a central opening being circular in cross-section and having a constant diameter;

coupling said first rigid support ring concentrically to one end of said disk stack against one end rigid disk of said disk stack; and coupling said second rigid support ring concentrically to a second end of said disk stack opposite said one end of said disk stack against a second end rigid disk of said disk stack; and providing said constant diameter of said central opening of said first and second rigid support rings substantially equal to the major diameter of the central aperture, said rigid support rings supporting a rotor nutatively disposed in said helically convoluted elongated chamber by contact with the rotor.

11. The method of making the helical gear device of claim 10, wherein the step of fixing the rigid disks together includes inserting the disk stack in a tube, and bonding the disk stack to the tube to become a rigid assembly.

12. The method of making the helical gear device of claim 11, further comprising bonding the first and second rigid support rings to the tube and to the disk stack to become a monolithic structure.

13. The method of making the helical gear device of claim 10, further comprising bonding the first and second rigid support rings to the disk stack to become a monolithic structure.

14. The method of making the helical gear device of claim 10, further comprising forming the disk stack with a saw tooth interior wall surface that during nutative communication with the rotor provides a labyrinth seal therebetween.

15. The method of making the helical gear device of claim 10, further comprising forming an inner lining within the helically convoluted chamber.

16. A helical gear device, comprising:

a stator comprising a means for stacking a plurality of rigid disks in aligned face-to-face stacked relationship with one another with each of said rigid disk being rotated with respect to the next adjacent rigid disks progressively along the length of the aligned rigid disks in one direction of rotation to define a helically convoluted elongated chamber, each of said rigid disks including an interior surface defining a central aperture in cross-section, said interior surface including a plurality of circumferentially spaced-apart, radially inwardly extending lobes and surface regions between said lobes and wherein diametrically opposed surface regions between said lobes provide the major diameter of said central aperture, said lobes corresponding to the helical lobes of a rotor where the rotor has one less lobe than the stator;

means for fixing the rigid disks together to make a bonded disk stack;

means for coupling a first rigid support ring concentrically to a rigid disk at a first end of the disk stack; and means for coupling a second rigid support ring concentrically to a rigid disk at a second end of the disk stack opposite the first end, each of said first and second rigid support rings having a central opening being circular in cross-section and having a constant diameter substantially equal to the major diameter of the central aperture said rigid support rings supporting a rotor nutatively disposed in said helically convoluted elongated chamber by contact with the rotor.

17. The helical gear device of claim 16, wherein the means for fixing the rigid disks together includes means for bonding the disk stack to the tube to become the rigid assembly.

18. The helical gear device of claim 17, further comprising means for bonding the first and second rigid support rings to the tube and to the disk stack to become a monolithic structure.

* * * * *